US006175964B1

(12) United States Patent
Adler

(10) Patent No.: US 6,175,964 B1
(45) Date of Patent: Jan. 23, 2001

(54) MULTIPURPOSE SPORT AND LEISURE GARMENT

(76) Inventor: Mitchell Adler, 115 E. 87th St., New York, NY (US) 10128

( * ) Notice: Under 35 U.S.C. 154(b), the term of this patent shall be extended for 0 days.

(21) Appl. No.: 09/366,838

(22) Filed: Aug. 4, 1999

(51) Int. Cl.[7] ..... A42B 5/00
(52) U.S. Cl. ..... 2/207; D6/608
(58) Field of Search ..... 2/207, 91, 151, 2/209.3, 144, 279, 300, 88, 209.11; D6/608; 62/259.3

(56) References Cited

U.S. PATENT DOCUMENTS

| | | | | |
|---|---|---|---|---|
| D. 108,757 | | 2/1938 | Tannenbaum . | |
| D. 318,972 | | 8/1991 | Chestnut | D6/608 |
| D. 380,119 | * | 6/1997 | Gonzalez | D6/608 |
| D. 414,645 | * | 10/1999 | Cooper | D6/608 |
| 718,730 | | 1/1903 | Scheuer | 2/91 |
| 816,231 | * | 3/1906 | Hill et al. | 2/207 |
| 830,482 | * | 9/1906 | Lungren | 2/207 |
| 968,199 | * | 8/1910 | Schwartz | 2/91 |
| 1,072,735 | * | 9/1913 | Kellner et al. | 2/207 |
| 1,095,740 | | 5/1914 | Seidman . | |
| 1,652,982 | | 12/1927 | Grean | 2/91 |
| 1,916,507 | | 7/1933 | Green et al. | 2/91 |
| 1,936,045 | * | 11/1933 | Bachrach | 2/91 |
| 2,355,290 | | 8/1944 | Gold | 2/91 |
| 2,385,791 | * | 11/1945 | Bye | 2/91 |
| 2,402,996 | * | 6/1946 | Geissmann | 2/91 |
| 2,413,318 | | 12/1946 | Golfieri | 2/207 |
| 2,620,478 | * | 12/1952 | Fraum | 2/91 |
| 2,870,448 | * | 1/1959 | Rosenthal | 2/91 |
| 2,942,274 | | 6/1960 | Ross | 2/91 |
| 3,080,566 | | 3/1963 | Neumann | 2/91 |
| 3,115,640 | | 12/1963 | Wiest | 2/151 |
| 3,260,292 | | 7/1966 | Costello | 150/1.7 |
| 3,605,121 | | 9/1971 | Suzuki | 2/207 |
| 3,668,707 | | 6/1972 | Williams | 2/207 |
| 3,894,296 | | 7/1975 | Hirschbeck | 2/91 |
| 4,037,340 | | 7/1977 | Owensmirth | 40/129 A |
| 4,277,849 | | 7/1981 | Spears | 2/144 |
| 4,404,688 | | 9/1983 | Knight | 2/207 |
| 4,870,707 | | 10/1989 | Hayes | 2/88 |
| 5,072,598 | | 12/1991 | Dibrell | 62/259.3 |
| 5,086,629 | | 2/1992 | Dibrell | 62/259.3 |

* cited by examiner

*Primary Examiner*—John J. Calvert
*Assistant Examiner*—Alissa L. Hoey
(74) *Attorney, Agent, or Firm*—Thomas J. Parker; Bryan Cave LLP

(57) ABSTRACT

A garment comprising first and second sections of substantially equal size arranged on opposite sides of a vertex. The distal portions of the first and second sections have greater fabric surface than the medial portion of the garment. When the medial portion is draped on or about the body, the medial portion imparts a more sparse appearance than the distal portions of the first and second sections. When the garment is draped around an area of the body, the first and second sections form a generally collapsed cone-shaped configuration, displaying a neat and attractive appearance when the garment is worn.

23 Claims, 23 Drawing Sheets

MULTIPURPOSE SPORT AND LEISURE GARMENT

BACKGROUND OF THE INVENTION

The present invention relates to a garment which may be worn comfortably on or about the body, such as, for example, the head, chest, shoulder, thigh, knee, arm or waist. Specifically, the present invention is directed to a garment, which, when worn, distributes areas of high fabric surface away from the point of body contact and imparts sparsity of fabric at body contact. This is accomplished by placing two sections of fabric on opposite side of a vertex. Such configuration, as herein described, allows the present garment to have multiple utilities and uses not found in ordinary garments.

Towels used for wiping and drying moisture are commonly used in connection with physical activity. Typically, the towel is transported by hand to or from the pursuit of physical activity, or is sometimes worn about a body area, such as the shoulder or neck. The towel provides exceptional water absorbency and is used to regulate body temperature. However, towels are not designed nor intended as items of wear, nor do they contain pockets. For instance, when draped over a body part, such as the neck or shoulder, the towel exhibits undesirable characteristics, such as a bulky and cluttered appearance at the point where the towel is worn. Towels having a narrow width (so as not to be bulky at the point of wear) provide an insufficient amount of absorbent surface to be useful in drying, wiping or regulating body temperature, nor does it provide a high degree of fashion. Long towels cover larger areas of the body and provide more absorbency and temperature regulation, but are too bulky at the points of body contact to be fashionable.

When fabricated of a substantially stretch resistant absorbent fabric, the present garment may be used for wiping and drying liquids such as perspiration and water. The present garment may also be used as a means for regulating the temperature of the body. Further, the present garment may be fashionable, imparting a sparse appearance at the segment of the body area which it is worn. The present garment may also contain pockets or be emblazoned.

SUMMARY OF THE INVENTION

It is an object of the present invention to provide a garment that may be worn about the body comfortably without the drawbacks typically associated with conventional towels, such as gathering or bulkiness about the body contact area or inadequate dimension for intended use. Another object of the present invention is to provide a garment with the foregoing advantages that possess the hand or feel of a conventional towel suitable for wiping and drying liquid from the skin or regulating body temperature. A further object of the present invention is to provide a garment with the foregoing advantages that may be a fashionable item of wear with a wide range of uses. A further object of this invention is to provide a garment with the foregoing advantages and means for incorporating pockets.

The present garment has a configuration comprising first and second sections of substantially equal size arranged on opposite sides of a vertex. The vertex is at a fixed point situated generally along a first direction. The proximal portion of each of the first and second sections is situated about the area where the vertex joins these sections. The medial portion of the garment is situated at the area of the vertex and generally extends along the first direction between the proximal portions of the first and second sections. The ends of the distal portions of the first and second sections furthest away from the vertex may extend generally in a direction perpendicular to the first direction. The shape of these ends may include a myriad of designs or curvatures, including elliptic or cheveroned. The distal portions of the first and second sections have greater fabric surface than the medial portion of the garment. When the medial portion of the garment is draped around an area of the body, the medial portion imparts a more sparse appearance of fabric about the area of the body which that portion is engaged than the distal portion of the first and second sections. When the garment is draped around an area of the body, the first and second sections may form a generally collapsed cone-shaped configuration, displaying a neat and attractive appearance when the garment is worn.

As used in the specification and claims herein, the term "cone" or "conic" means a surface which is generated by passing a line through a fixed point and a fixed plane curve not containing the point, consisting of two sections joined at a vertex. The fixed plane curve ensures a smooth collapse of the first and second sections during wear.

The configuration of the first and second sections of the present garment may be defined having three points: base, altitude and vertex. The length of the base, altitude or vertex may be adjusted to suit intended use, as will become evident in the descriptions herein. Additionally, a collar comprising an elongated tube may be placed about the medial portion of the garment to impart greater fabric surface, or the collar may be used to further separate the distal portions of the first and second sections. The fabric of the collar may differ from or be identical or substantially similar to the fabric of the first and second sections of the garment. In another preferred embodiment, the surface of the first and second sections may be wavy. Additionally, the present invention may comprise pieces of fabric joined together or be constructed of one single, continuous piece of fabric.

Conventional towels used during physical activity are flat and two dimensional. The garment of the present invention may include two, three dimensional sections substantially of equal size joined at a vertex. The advantage of constructing the present garment in this manner, as opposed to a single, rectangular or square piece of fabric, is the sparse appearance exhibited at the point of body contact while providing a large surface of absorbent fabric at either end of the garment. The three dimensional configuration of the present garment allows the garment to collapse upon itself when worn. As a result, the drape exhibited by the present garment when worn is more elegant than the drape of a standard towel and the collapsed cone-shaped configuration provides a more streamlined appearance.

In another preferred embodiment, the altitude of the first and second sections may equal zero, and consist of two substantially equal sections connected at the vertex area directly or by an elongated tube. When the altitude of the sections approximates or equals zero, the sections are planar. Connecting the sections with a circular pattern creates a collapsed cone having a narrow vertex when the garment is worn. Whereas connecting the sections with a rectangular pattern creates a truncated vertex when the garment is worn. To create an elliptical planar design, the vertex joining the sections may be moved from the medial portion to one of a proximal portion of the sections, creating a collapsed cone with an elliptical base when the garment is hung or worn.

Other embodiments of the present garment may encompass a number of permutations of altitude to base ratio, yielding myriad variations of feature attributes, allowing the present garment to be suitable for a wide variety of uses.

Suitable fabrics for the present invention may include, for example, cotton, linens, knits, woven and non-woven fabrics. Other suitable fabrics may include an absorbent, towel-like fabric that is substantially stretch-resistant, such as terry. A suitable terry is single-faced terry where the looped face may become the exterior surface of the present garment. This construction allows the sections to move more freely in opposition to each other. There are additional types of terry cloth known in the art which may be suitable for the present invention. Such terrys may include, but is not limited to, double-faced terry, Turkish terry, French terry, boucle, velour or baby terry.

The pile density of the fabric for the present garment may vary depending upon intended use and cost. For instance, in cooling body temperature, the garment may be soaked in water and applied to the body. A dense pile with high and large loops will hold more water for cooling or absorbing more moisture when dry. A less dense pile will drape more loosely and is more appropriate to situations where moisture absorption is not critical.

By varying the pile density from light to medium to dense, the absorbency and drape characteristics of the present garment change. This allows the function of the present garment to be varied for its intended use. For instance, by increasing the pile density of the fabric, the towel-like feel or "hand" more closely resembles a bath towel. Increasing the density stiffens the fabric and reduces drapability. This may be desirable depending on function and intended use. Additionally, the distal portion of the first and second sections may be made larger or smaller to regulate fabric surface.

For a more fashionable appearance, the present garment may comprise of non-absorbent or stretchy fabrics including, but not limited to, knits and wools. The fabric of the present garment may comprise an insulating fabric, including, but not limited to wool, microfiber, fleece, ultra suede, felted fabrics, padded fabrics, thinsulate™, or any combination thereof. Other suitable fabrics may also include water repellant fabrics, such as, for example, Gortex™, nylon, plastic, rubber, Teflon, or any combination thereof. Fabrics treated with a water repellant coating may also be suitable. Additional suitable fabrics for the present garment may include silk, rayon, mesh, leather, velvet, cashmere, camel hair or any combination thereof.

There are general coordinates that identify proper size and configuration of the present garment based upon general use and wear. A basic proportion may be transposed from a standard towel size, such as 24"×36". The length of the garment may become 36" and the ends of the first and second sections may have a width of 24". A user wearing the garment during physical activity may want smaller dimensions to prevent the garment from interfering with the activity. A shortened version of the present garment may comprise sufficient fabric to prevent gathering of fabric at the point of body contact. The length of the present garment may be worn on the neck and the distal portions of the first and second sections do not extend to the wearer's extremities.

A user may desire more fabric surface and length for wrapping or draping the present garment about the body after engaging in physical activity. When the medial portion of the garment is placed around the neck, for example, the distal portions of the first and second sections may fall at or below the wearer's waist. Here, the width of the ends of the first and second sections may be 18", 24", 36" or 42". The minimal length of the present garment may be sufficient to wrap around any portion of the body. The maximum length may be limited to prevent the garment from touching the ground or becoming entangled or be otherwise dangerous when worn.

The garment may be used to protect the user from wind or cold, yet retain its absorbent properties. In hot weather, the garment may be used to cool the wearer by offering protection from the sun and by absorbing perspiration. In addition, the garment may be soaked in cold water to cool the wearer. The garment may also be worn to cover parts of the body that may be inappropriately displayed. For example, a topless sunbather leaving the bathing area may use the present garment to cover the appropriate body parts. In this regard, the present invention may be manipulated, for example, into a halter top, toga, pareo, sarong or skirt.

The three dimensional configuration of the present garment allows for concealment of pockets anywhere in the garment. For example, the present garment may have at least one pocket at or about the distal portions of the first and second sections. The pockets may comprise a means for opening and closing the pockets, such means may include snaps, buttons, zippers or Velcro.

The claimed invention may contain fasteners, such as snaps, clips, Velcro, zippers, buttons or any other sealers, fasteners, closures or trims at about or along the garment's edges. Fasteners enable the present garment to be folded in various ways to perform different useful functions (e.g., poncho, beach towel or chair cover). Zippers, when used, may be recessed and made of nylon instead of metal. Buttons made of soft rubber or Velcro are also preferred fasteners. The claimed invention may also be emblazoned at either of the first or second sections, or both.

These and other embodiments of the present invention will become apparent to those of ordinary skill in view of the disclosures herein.

DETAILED DESCRIPTION OF THE PREFERRED EMBODIMENT

Figure 1A:
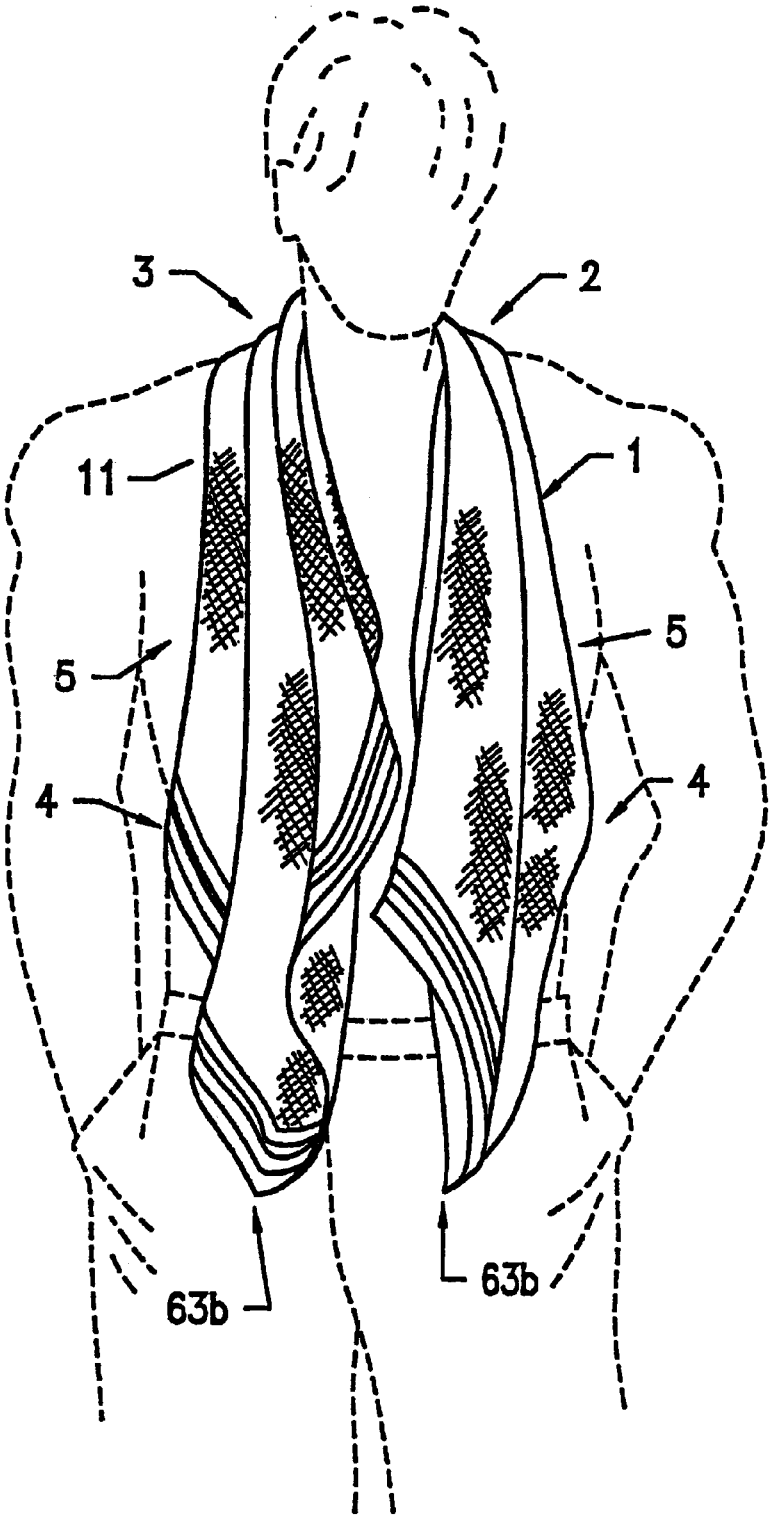
FIG. 1*a* is a frontal view of the present garment having an elliptical base and being worn about the neck.
Figure 1B:
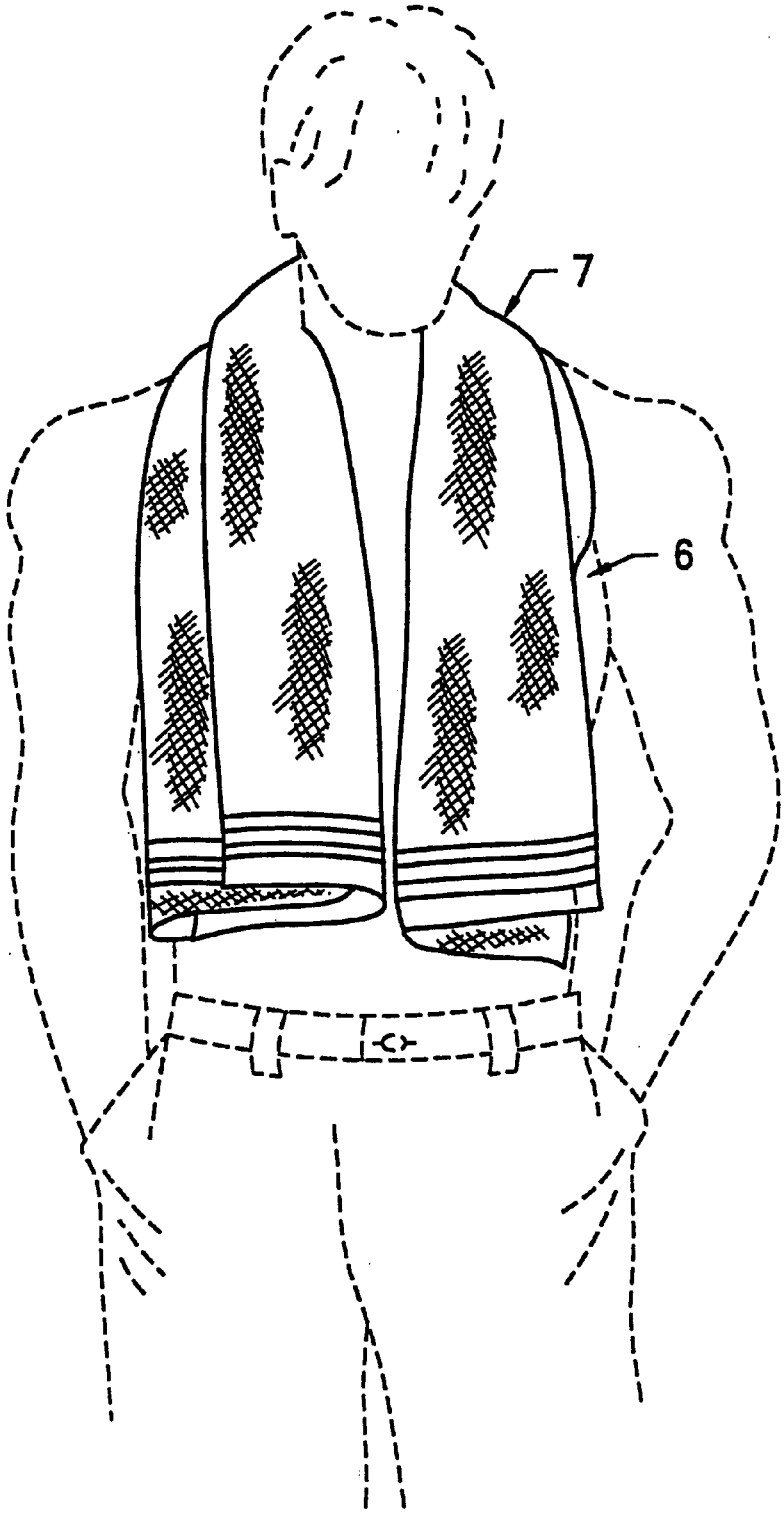
FIG. 1*b* is a frontal view of a standard towel being worn about the neck.

FIGS. 1–2 illustrates the difference in fabric distribution at the point of body contact between the present invention and a conventional towel when. FIG. 1*a* is a front view of an embodiment of the present garment (1) worn about the neck (2). The garment (1) may be easily draped upon the body and imparts a sparse appearance at contact point (3). Additionally, there is sufficient fabric at the distal portions (4) of the first and second sections (5) to be both functional and fashionable when the garment is worn. FIG. 1*b* is a front view of a standard towel (6) worn about the neck (7). The towel (6) is bunched and gathered at the body's contact (7) rendering it too bulky to be fashionable or functional when worn.

Figure 2A:
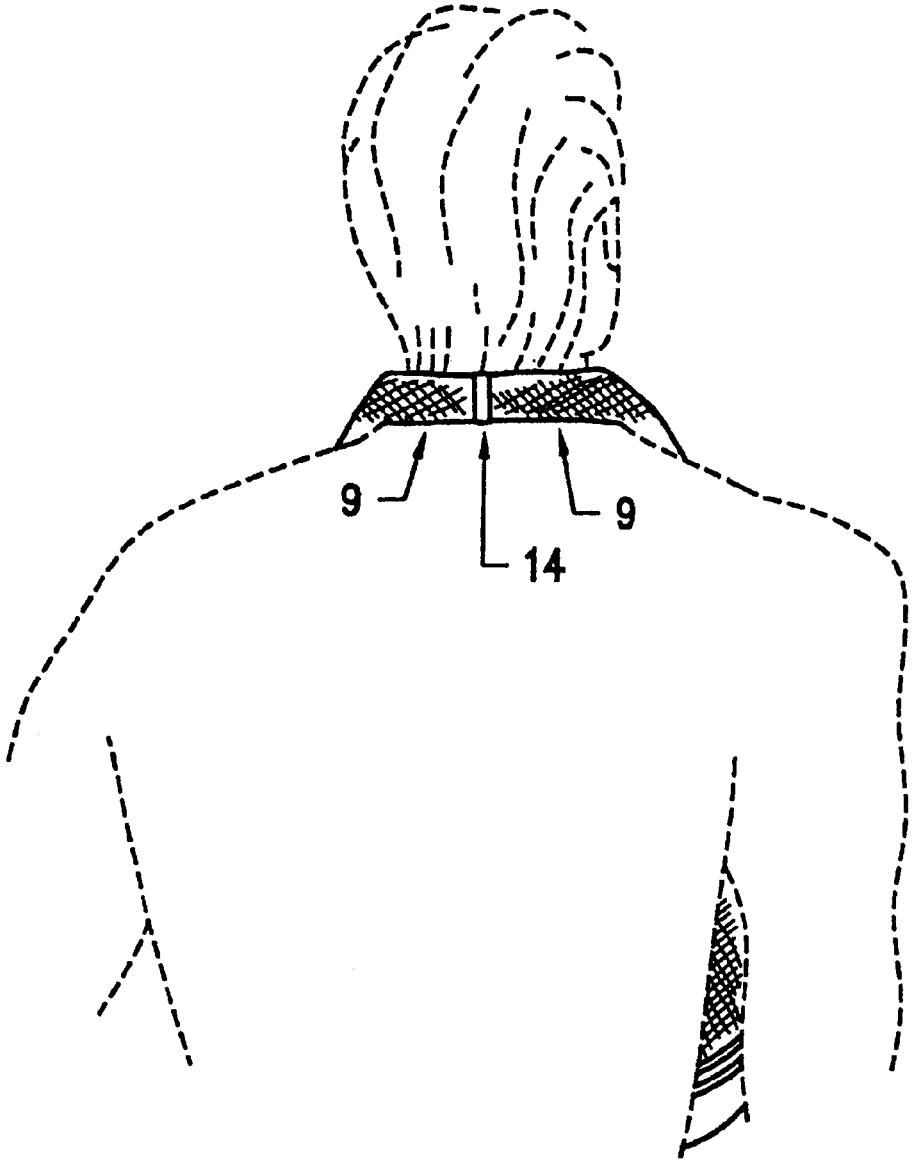
FIG. 2*a* is a back view of the present garment shown in FIG. 1*a*.
Figure 2B:
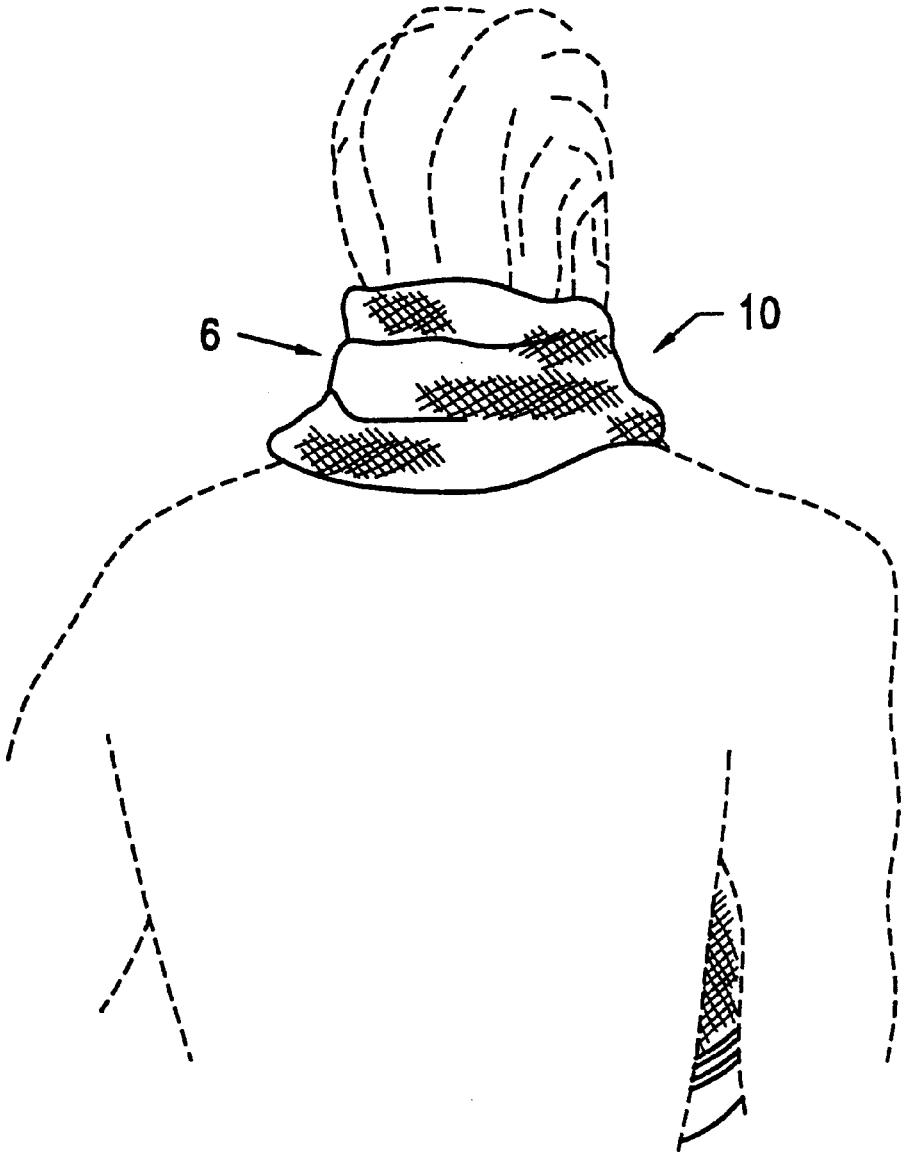
FIG. 2*b* is a back view of the standard towel shown in FIG. 1*b*.

FIG. 2*a* is a back view of the garment shown in FIG. 1*a*. The surface of fabric at the medial portion (9) is substantially less compared to the standard towel (6) shown in FIG. 2*b*. The sparseness of fabric about the neck allows the user to wear additional articles of clothing such as a jacket, coat, robe, or other similar article. FIG. 2*b* is a back view of the standard towel (6) shown in FIG. 1*b*. FIG. 2*b* illustrates the bulkiness (10) of the standard towel (6) when worn at or about the neck.

FIGS. 3–9 and 11 show various embodiments of the present invention which may be used in various ways, including a scarf, sport towel, pareo, poncho, skirt, camisole, sarong, halter top or any other body wrap. Specifically, each of these figures show a garment of the present invention comprising first and second sections (12 and 13, respectively) of substantially equal size. The sections are arranged on opposite sides of a vertex (14) or separated vertex (14*a*) which join the first and second sections (12 and 13). The vertex is at a fixed point situated generally along a first direction (62). The medial portion (16) of the garment is situated at the area of the vertex (14) and generally extends along the first direction (62) between the proximal portions (11) of the first and second sections (12 and 13). The ends (15*a*) of the distal portions (15) of the first and second sections (12 and 13) furthest away from the vertex (14 or 14*a*) may extend generally in a direction perpendicular to the first direction (62). The shape of these ends (15*a*) may be elliptic (63*a*), cheveroned (63*c*) or straight. The distal portions (15) of the first and second sections (12 and 13) have greater fabric surface than the medial portion (16) of the garment. When the garment is draped around an area of the body, the first and second sections (12 and 13) form a generally collapsed cone-shaped configuration (16*a*).

Figures 3A, 3B, 3C, 3D:
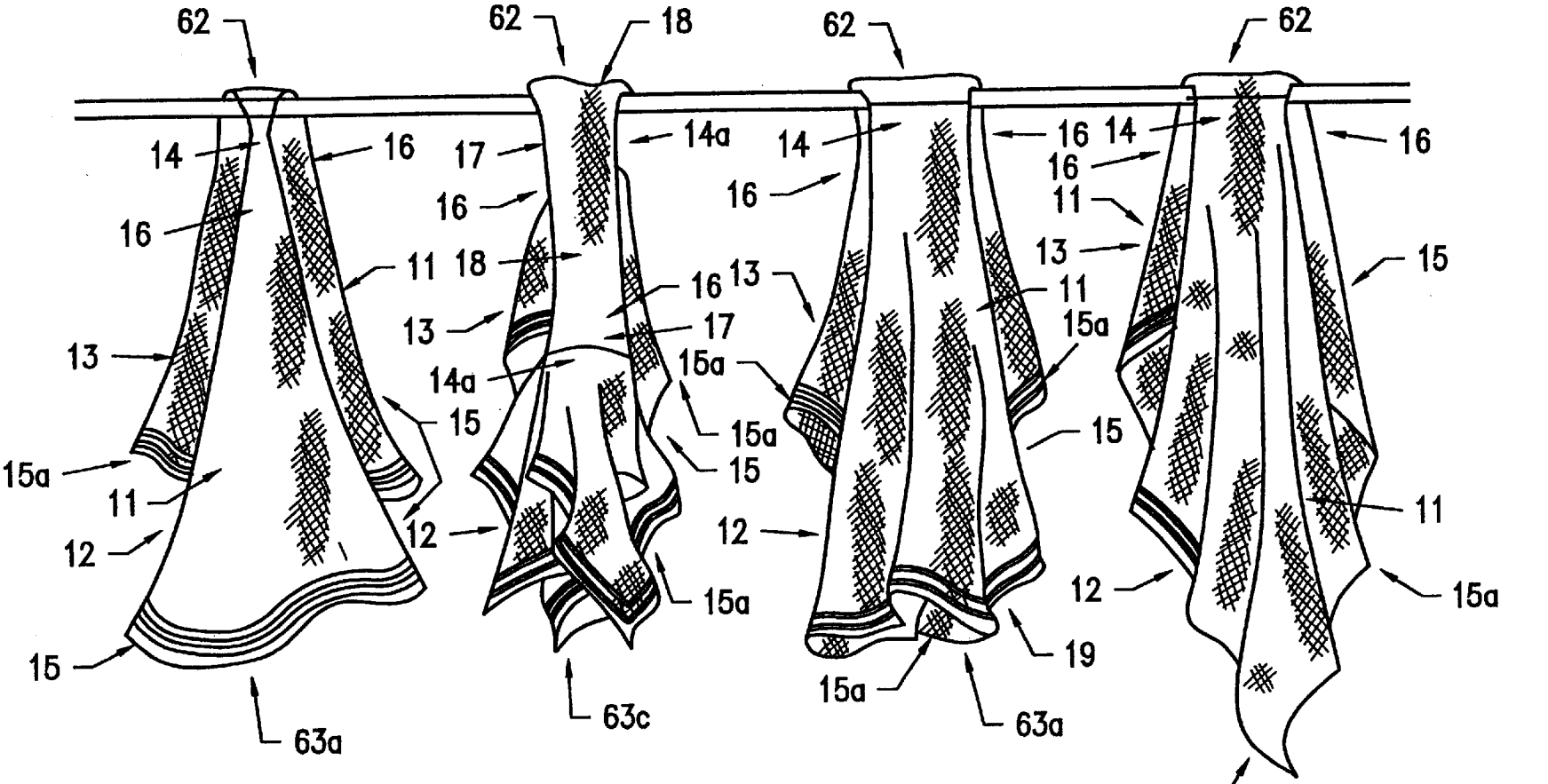
FIG. 3*a* is a front view of the present garment showing a cone-shaped configuration.
FIG. 3*b* is a front view of the present invention showing two planar sections separated by an elongated tube.
FIG. 3*c* is a front view of the present invention showing a cone-shaped configuration having a truncated vertex.
FIG. 3*d* is a front view of the present invention showing a cone-shaped configuration having a truncated vertex with an elliptical base.

FIGS. 3*a*–3*d* show various embodiments of the present inventions having a variety of uses. FIG. 3*a* shows the present invention having conic first and second sections. This configuration may be suitable use as a hat, scarf or sporting towel. FIG. 3*b* is an embodiment of the present invention comprising planar first and second sections (12 and 13) collapsing to form a cone-shape configuration when the garment is hung or worn. In FIG. 3*b*, the altitude of the first and second sections (12 and 13) equals zero. Also, the first and second sections (12 and 13) intersect at the bases (17) of an elongated tube (18). The elongated tube (18) imparts sparse fabric surface at body contact and further serves to separate the more voluminous first and second sections (12 and 13).

FIG. 3*c* shows the present invention with a vertex (14). Here, the vertex is truncated. The truncated vertex provides more fabric surface at the point of body contact. Another benefit of this embodiment is the larger base (19) of the first and second sections (12 and 13). FIG. 3*d* shows the present invention with an elliptical base (20) and a vertex (14) which is truncated. The elliptical base (20) allows the fabric surface to be reduced along the length of the first and second sections. Also, the elliptical base (20) configuration reduces the weight and absorbent surface of the first and second sections (12 and 13). The elliptical base enhances the drape of these sections.

Figure 4A:
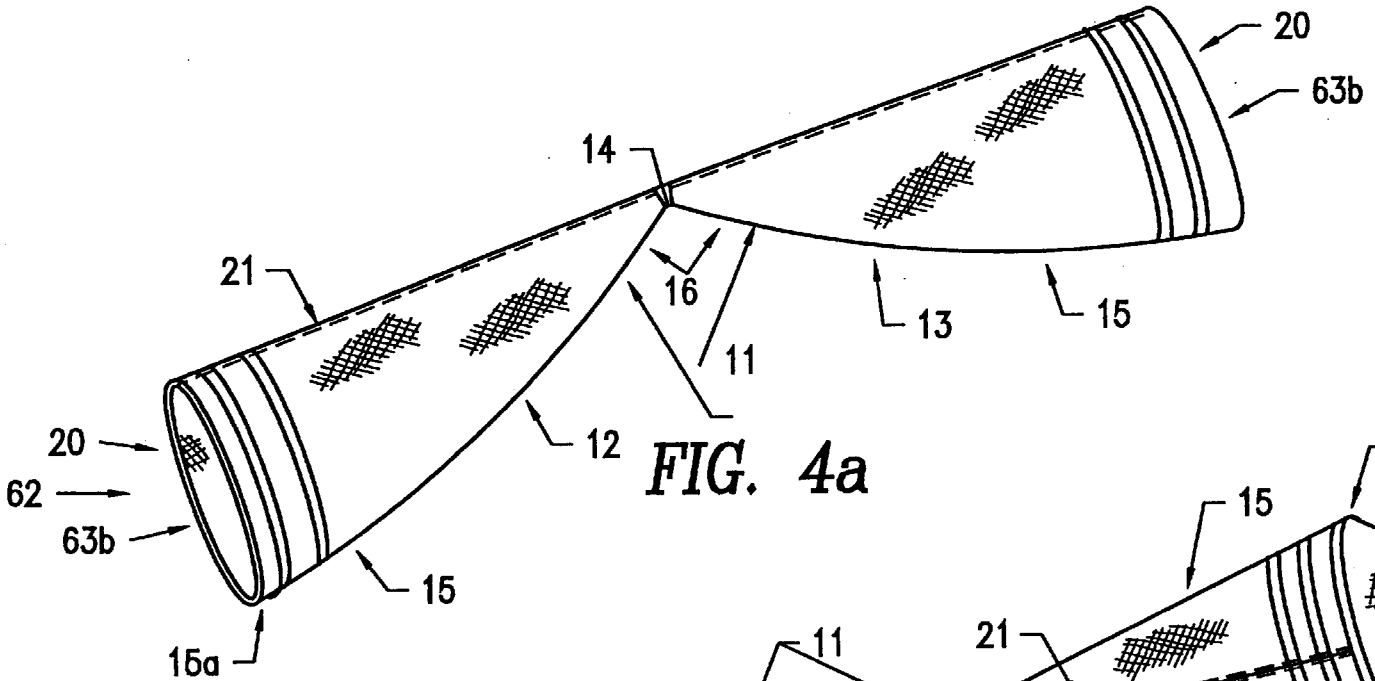
FIG. 4*a* is a side view of the present invention having an elliptical base with a truncated vertex.
Figure 4B:
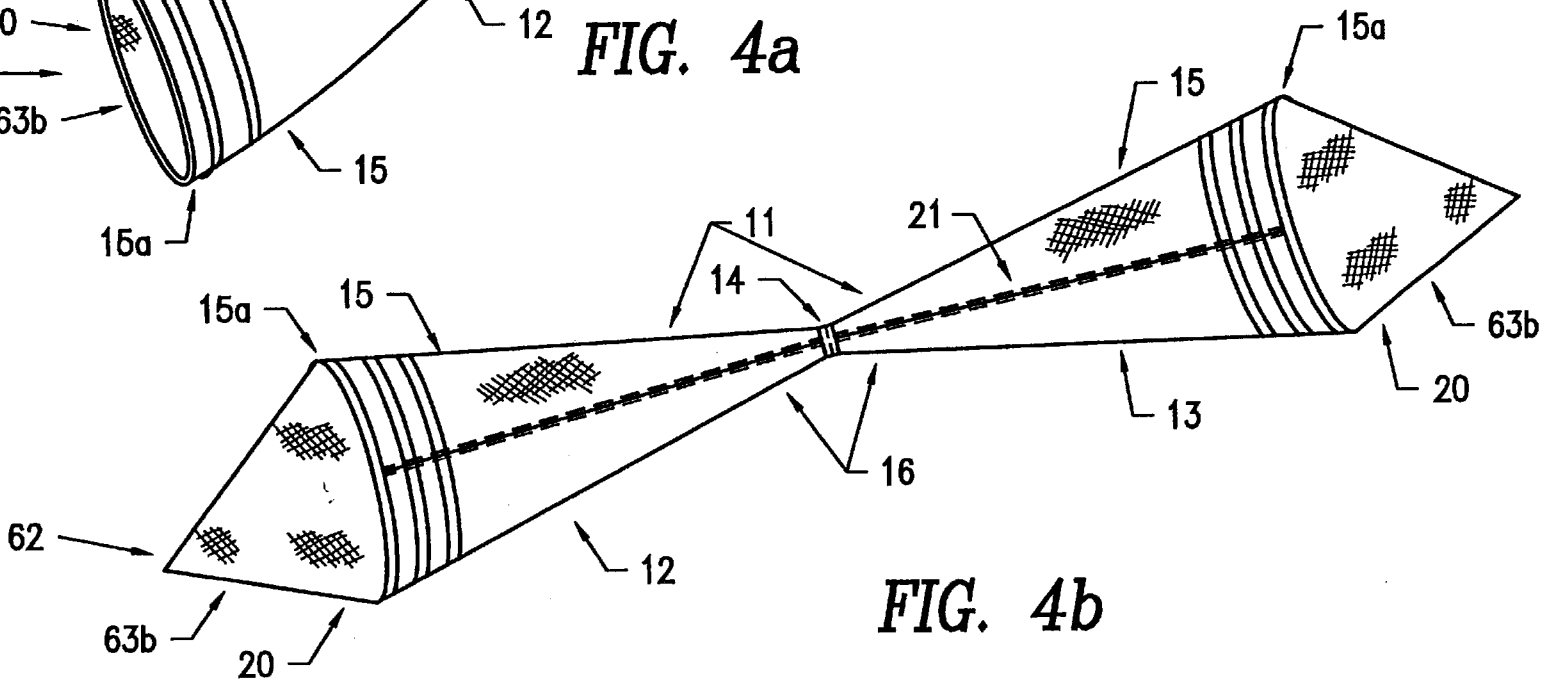
FIG. 4*b* is a bottom view of the present invention shown in FIG. 4*a*.

FIGS. 4*a* and 4*b* show a side and bottom view, respectively, of an embodiment of the present invention. Specifically, these figures show an elliptical base (20) with a vertex (14) which is truncated. The seams (21) are also shown.

Figure 5A:
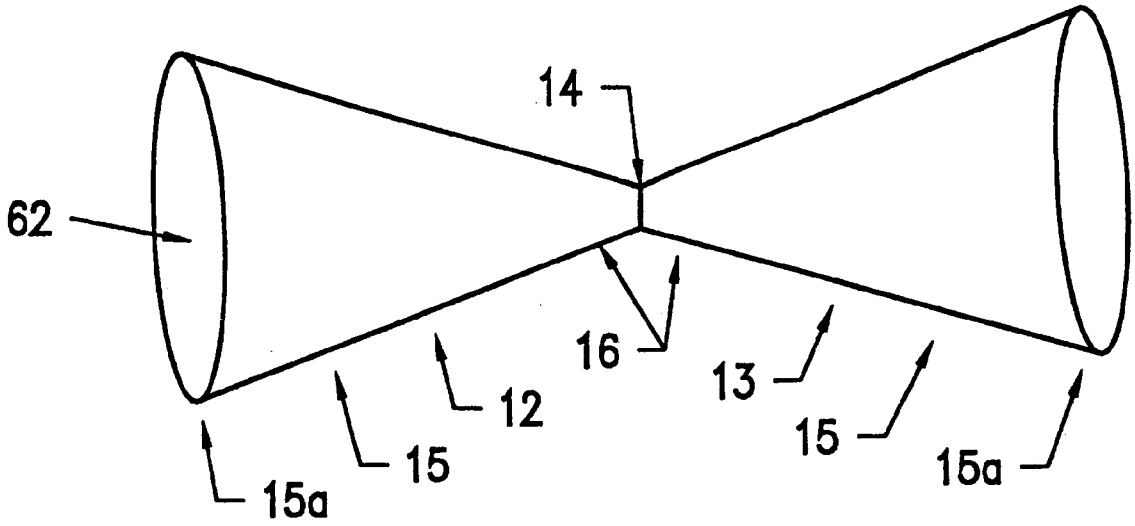
FIG. 5*a* is a schematic of the present invention showing high fabric surface first and second sections with a truncated vertex.
Figure 5B:
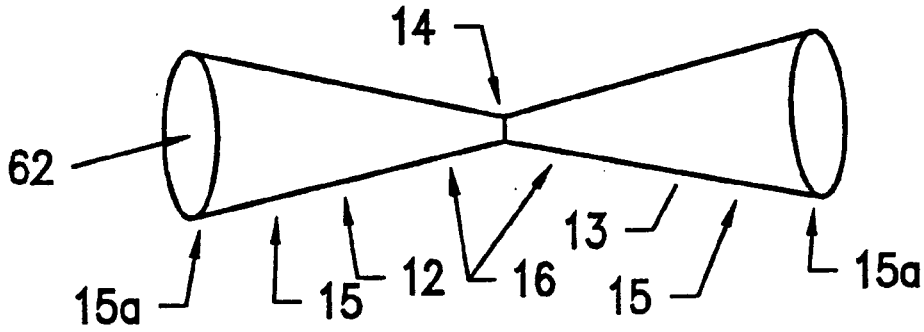
FIG. 5*b* is a schematic of the present invention showing low fabric surface first and second sections with a truncated vertex.
Figure 5C:
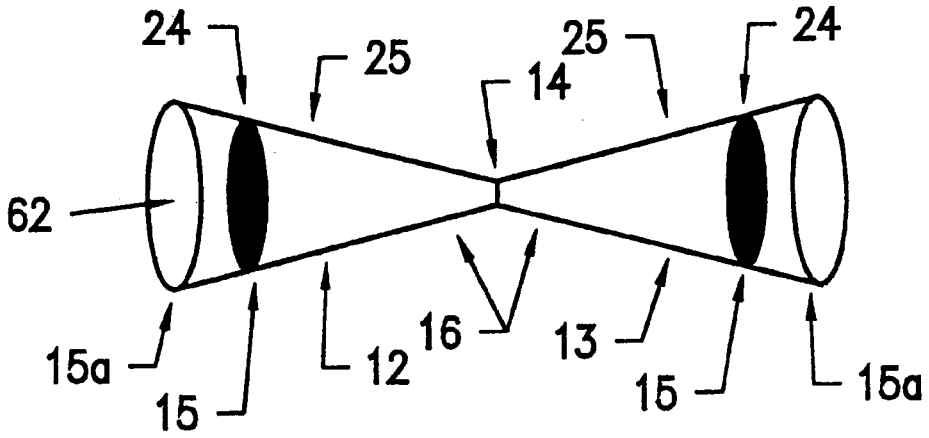
FIG. 5*c* is a schematic of the present invention showing low fabric surface first and second sections with a truncated vertex and disc pockets.
Figure 5D:
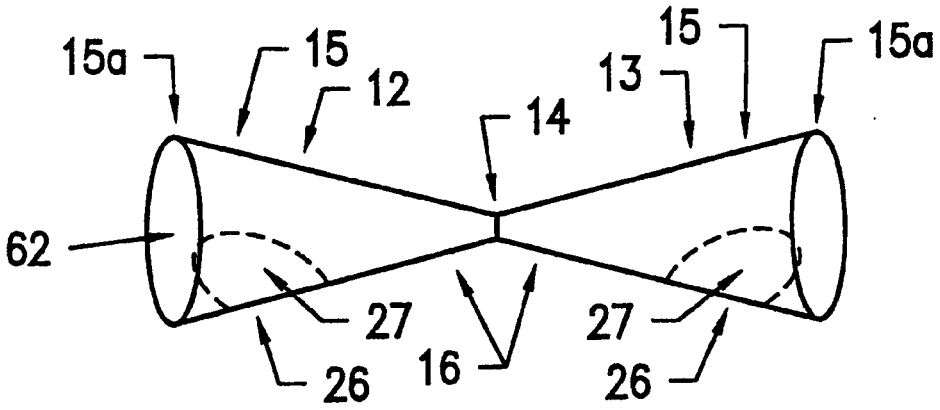
FIG. 5*d* is a schematic of the present invention showing low fabric surface first and second sections with a truncated vertex and pouch pocket construction.

FIG. 5*a* shows an embodiment of the present invention having high fabric surface at the first and second sections (12 and 13). This embodiment has a vertex (14) which is truncated. High fabric surface at the distal portions (15) of the first and second sections (12 and 13) provides greater absorbent surface area when the garment is worn. FIG. 5*b* shows first and second sections (12 and 13) with low fabric surface, and vertex (14) which is truncated. This configuration is ideal for smaller users or where less absorbent surface is required. FIGS. 5*c* and 5*d* show an embodiment of the present invention with pockets. In FIG. 5*c*, first and second sections (12 and 13) are connected on opposite sides of a truncated vertex (14). Disk (24) is affixed to the interior of each of the distal portions (15) of the first and second sections (12 and 13) forming a pocket. The opening of the pocket (25) is located at or near the disk (24). The size of the pocket opening is sufficient to accommodate at least one hand placing and removing objects from the pocket area. FIG. 5*d* shows first and second sections (12 and 13) with low fabric surface and a truncated vertex (14). Attached to the opening (26) is a pouch pocket (27).

Figure 6A:
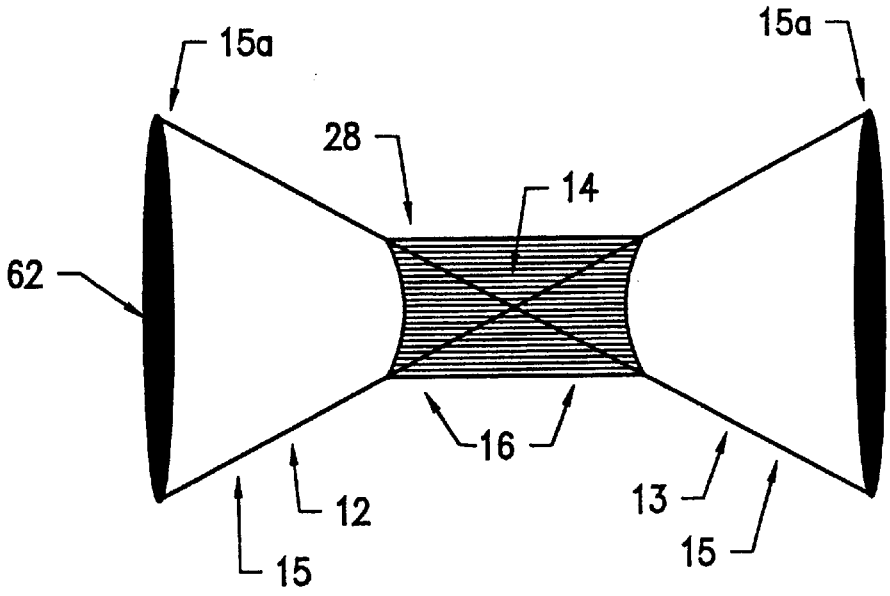
FIG. 6*a* is a schematic of the present invention showing high fabric surface first and second sections with an elongate and intact vertex.
Figure 6B:
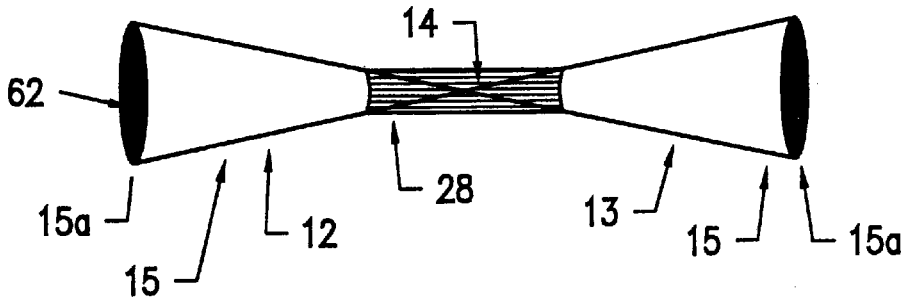
FIG. 6*b* is a schematic of the present invention showing low fabric surface first and second sections with an elongate and intact vertex.
Figure 6C:
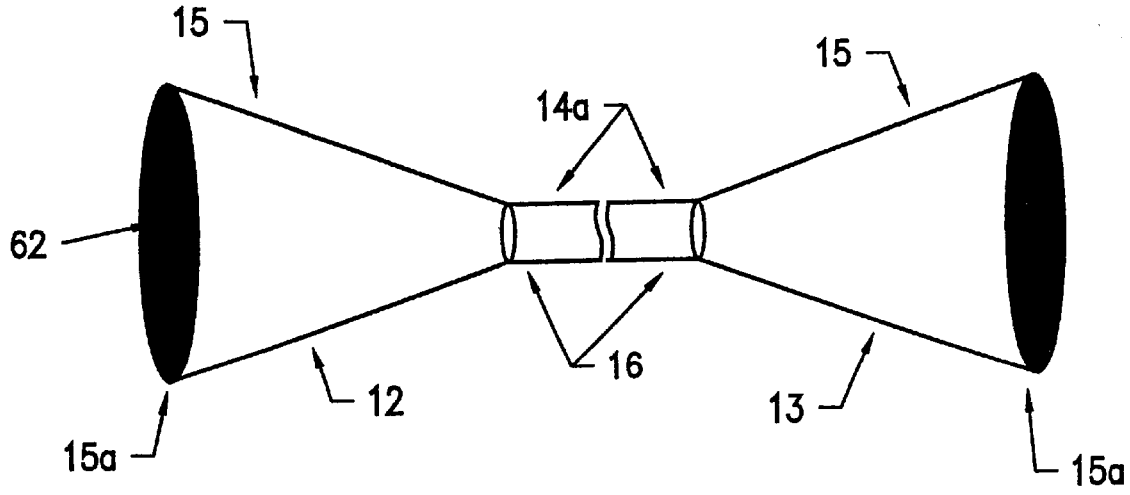
FIG. 6*c* is a schematic of the present invention showing high fabric surface first and second sections with an elongate and separated vertex.
Figure 6D:
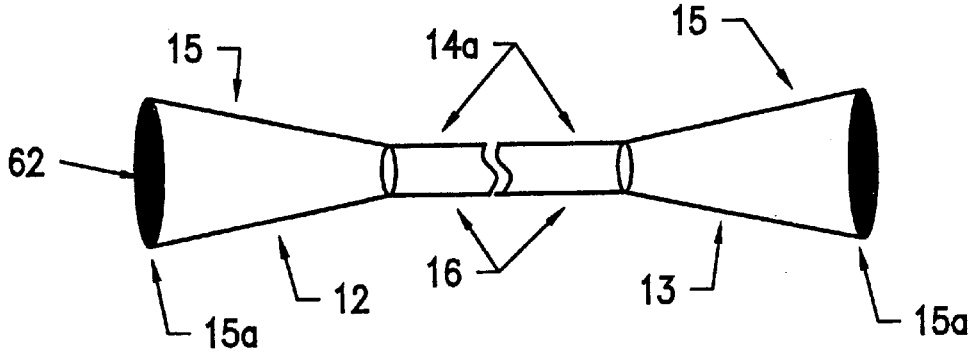
FIG. 6*d* is a schematic of the present invention showing low fabric surface first and second sections with an elongate and separated vertex.

FIGS. 6*a*–6*b* show embodiments of the present invention having a collar (28) around the medial portion (16). This configuration results in a garment of considerable medial strength and substantial fabric surface at the medial portion (16). The advantage of high fabric surface is greater absorbency, which renders this embodiment of the present invention suitable for use during strenuous athletic activities. FIGS. 6*c* and 6*d* show an embodiment of the present invention having a separated vertex (14*a*). The fabric surface created at medial portions (16) of first and second sections (12 and 13) is less than that of FIGS. 6*a* and 6*b*. The advantages of separated vertices is that the fabric surface remains static through the medial portion of the garment. And the areas of higher fabric surface are situated further down from the point of body contact.

Figure 7A:
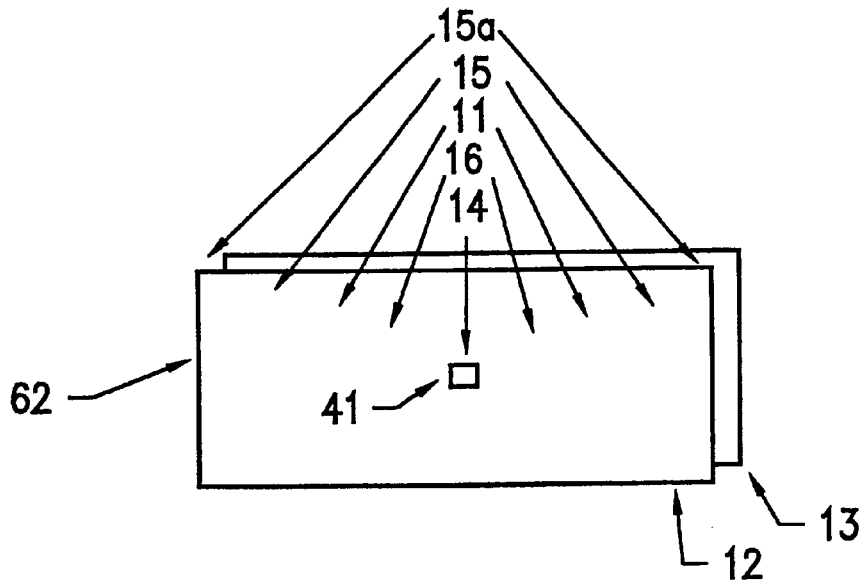
FIGS. 7*a*–7*d* is a schematic of an embodiment of the present invention showing two zero altitude planes connected at a vertex.
Figure 7B:
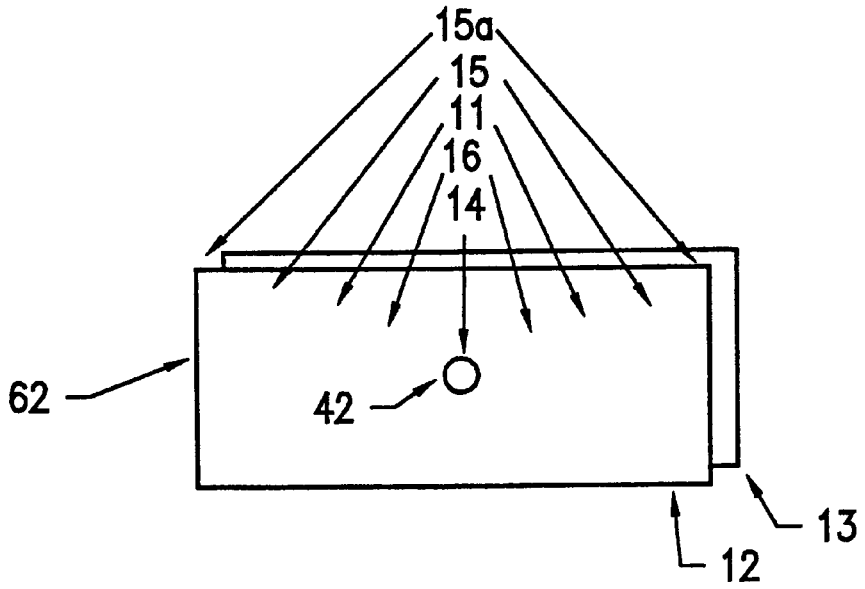
Figure 7C:
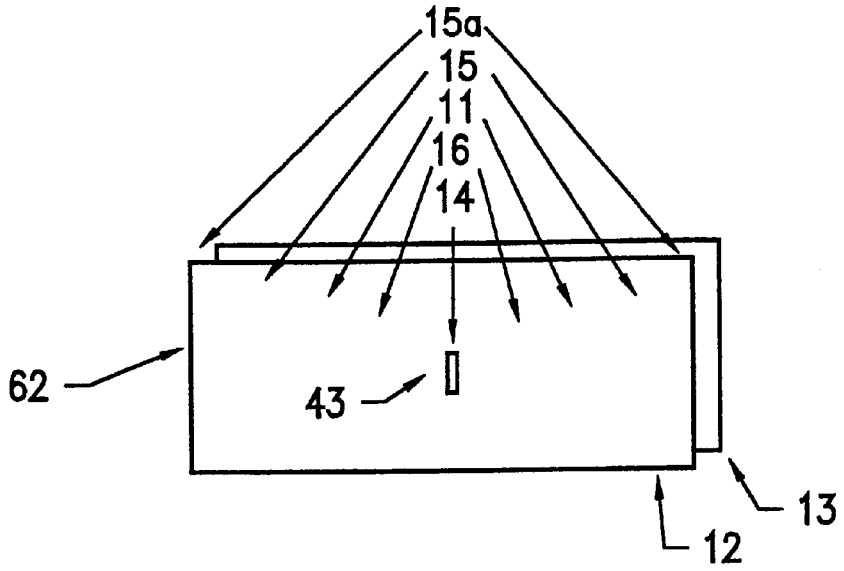
Figure 7D:
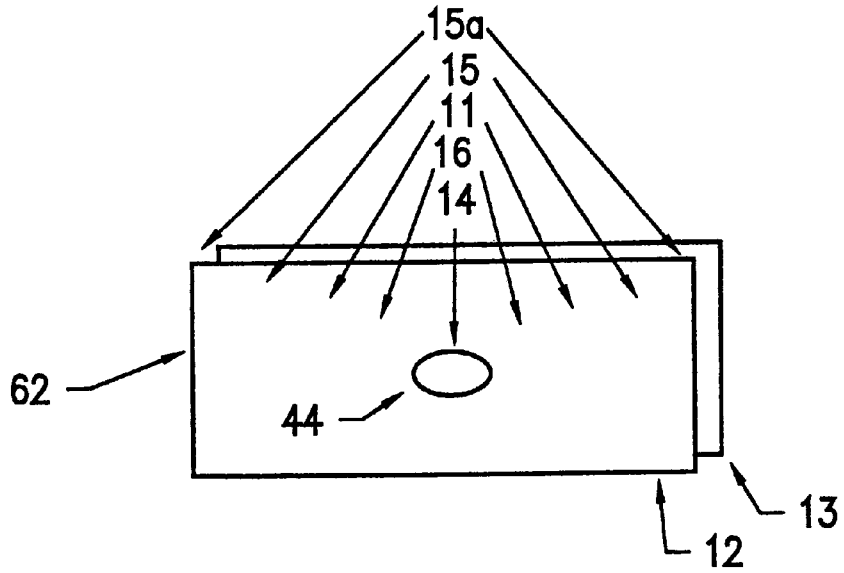

FIGS. 7*a*–7*d* illustrate various embodiments of the present invention having first and second sections (12 and 13) which are planar. Here, the shape of the area of the vertex affects the drape and base configuration of the present invention when worn. For instance, the embodiment of FIG. 7*a* shows the area of the vertex in the shape of a square (41). This positions the vertex such that the first and second sections (12 and 13) become four-sided pyramids when the garment is worn. The embodiment of FIG. 7*b* shows the area of the vertex in the shape of a circle (42). This positions the vertex such that the first and second sections become conic when the garment is worn. The embodiment of FIG. 7*c* shows the area of the vertex in the shape of a rectangle (43). This produces a truncated vertex and positions the vertex such that the first and second sections become conic when the garment is worn. In FIG. 7*d*, an elongated tube (44) connects planar first and second sections (12 and 13), wherein first and second sections form a collapsed cone when the garment is worn. The elongated tube (44) separates high fabric surface away from the point of contact. The elongated tube (44) may have open or closed ends. In regards to planar construction, the shape of the planes may take any form, such as, for example, square, circular, rectangular, triangular or any other polygon.

Figure 8A:
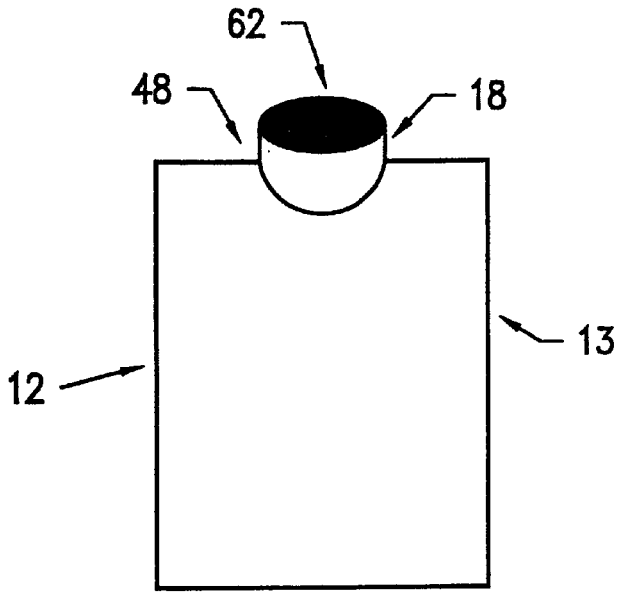
FIG. 8*a* is a front view of the embodiment of FIG. 7*d* when converted into a poncho.
Figure 8B:
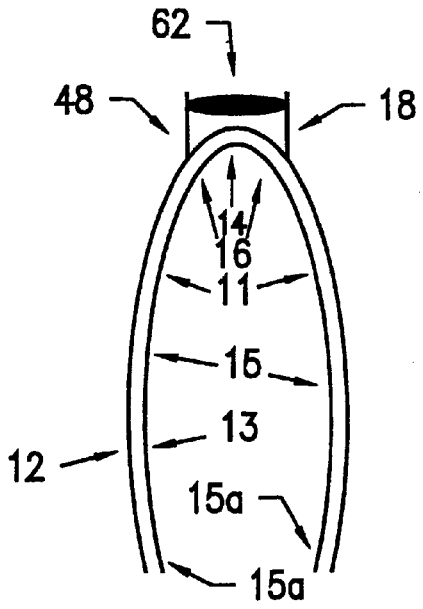
FIG. 8*b* is a side view of the embodiment of FIG. 8*a*.
Figure 8C:
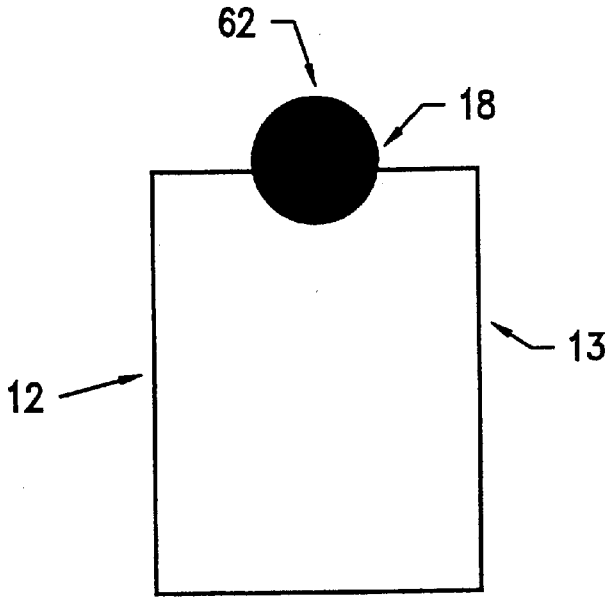
FIG. 8*c* is a front view of an embodiment of FIG. 7*d* with an elongate, which is used to convert said embodiment into a poncho.
Figure 8D:
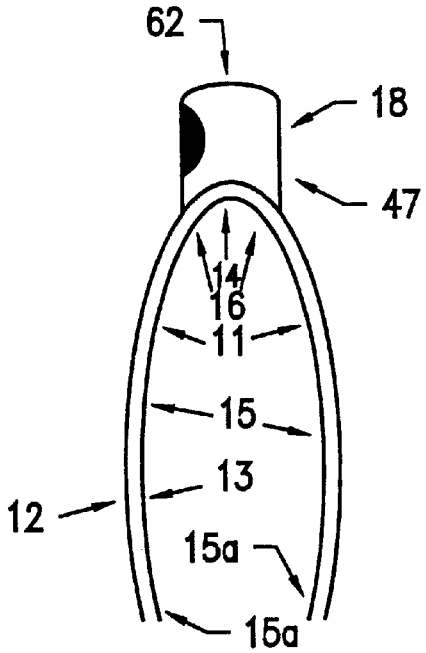
FIG. 8*d* is a side view of an embodiment of FIG. 8*c*.

FIGS. 8*a*–8*d* show the embodiment of FIG. 7*d* configured as a poncho. In FIGS. 8*a* and 8*b*, a short elongate (18) produces a low collar (48) when both planar first and second sections (12 and 13) are superimposed. FIG. 8*c* and 8*d* show two planar sections (12 and 13) intersected by an elongate (18). The elongated tube (44) moves the high fabric area further from body contact point to provide a hood. This embodiment may be used to create body wraps, pareo's, ponchos, beach towels and tunics of unique design as illustrated in FIGS. 11*a*–11*d*. For example, when the elongated tube (18) is of adequate diameter for insertion and removal over the wearer's head, the embodiment may be used as a poncho. In such a case, a short tube may create a collar (48) or a long tube may create a hood or head covering (47). The poncho may further comprise wind and water resistant fabric on the outer surface and an absorbent or insulating fabric on the garment's interior.

Figure 9A:
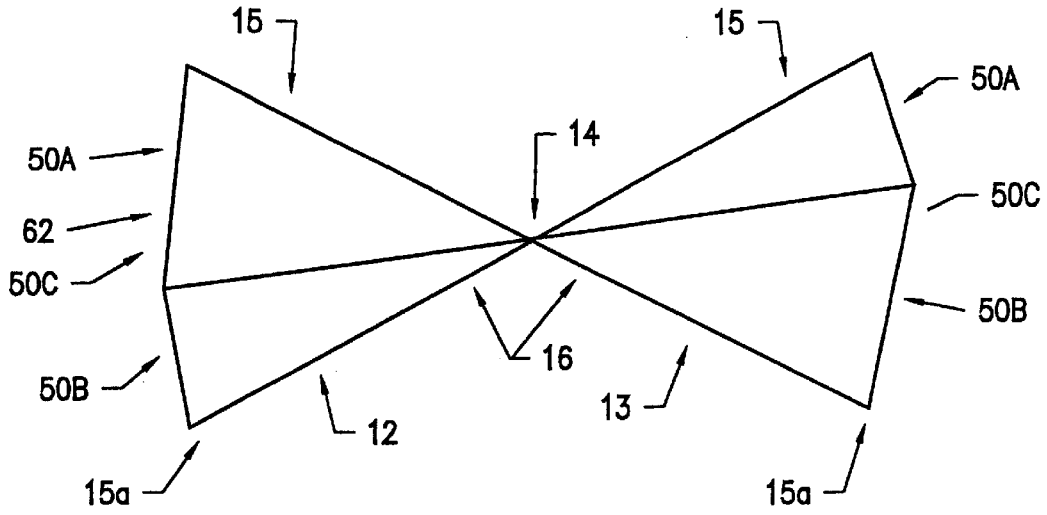
FIG. 9*a* is a schematic of an embodiment of the present invention showing first and second sections having a three-sided pyramidal configuration.
Figure 9B:
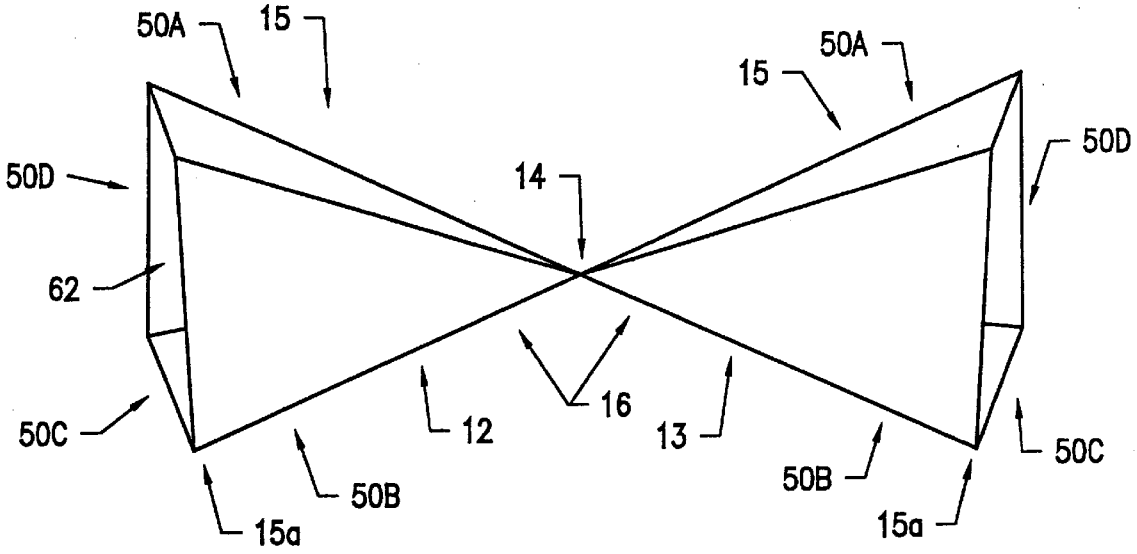
FIG. 9*b* is a schematic of an embodiment of the present invention showing first and second sections having a four-sided pyramidal configuration.

FIG. 9*a* shows an embodiment of the present invention having three-sided pyramidal first and second sections (50*a*–50*c*). FIG. 9*b* shows an embodiment of the present invention having four-sided pyramidal first and second sections (51*a*–51*d*).

Figure 10A:
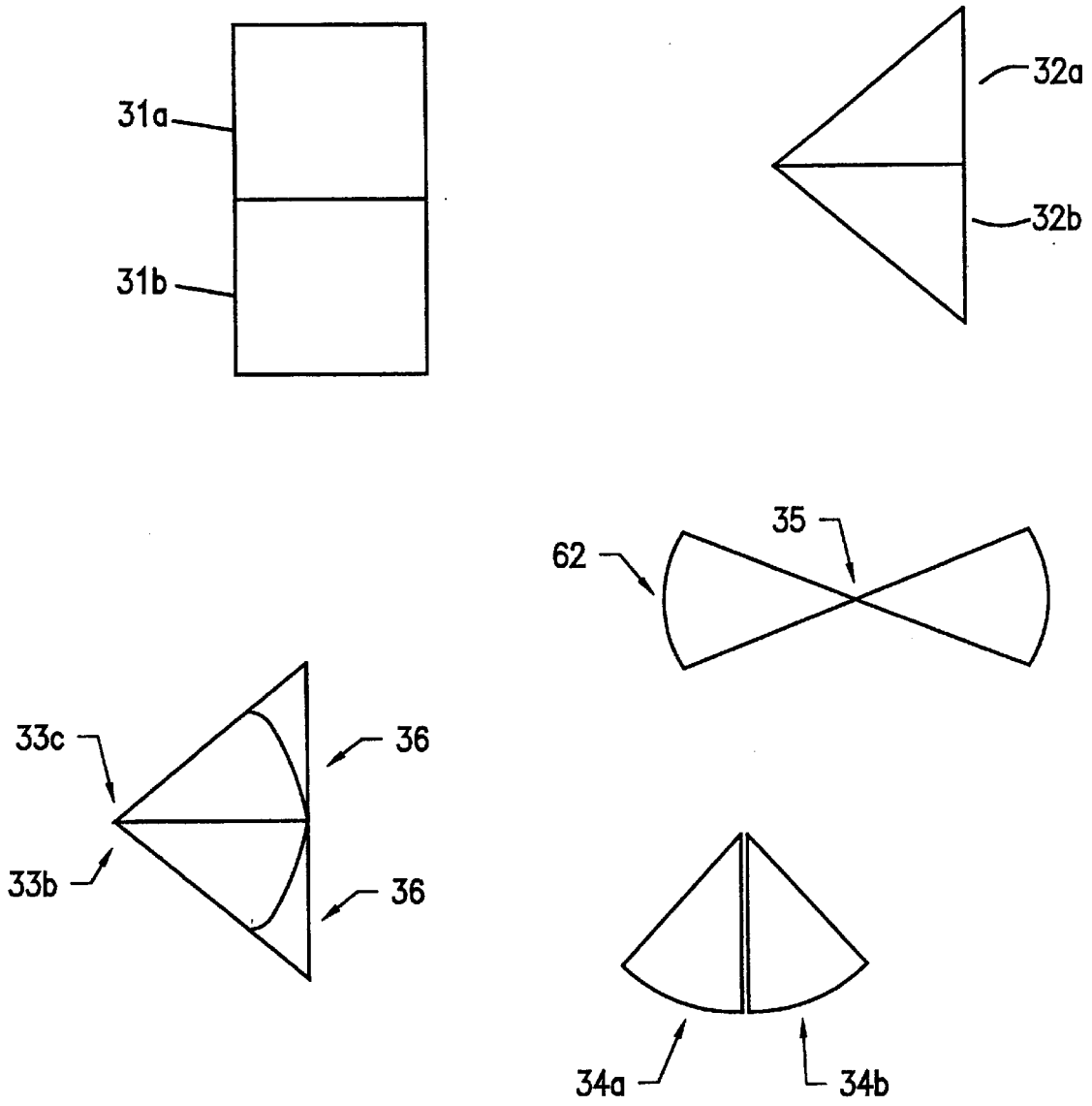
FIGS. 10*a*–10*c* show a schematic for constructing an embodiment of the present invention.

FIG. 10*a* shows a method of making the present invention having conic sections whereby opposing corners of two squares (31*a* and 31*b*) are folded in half to form two triangles (32*a* and 32*b*). A non-hypotenuse side of each triangle is sewn (33*a* and 33*b*) to form conic sections (34*a* and 34*b*). Conic sections (34*a* and 34*b*) are then attached at the vertex (35). When the solid area (36) is removed, it creates a flat base cone. If the solid area is not removed, it creates a an elliptical base.

Figure 10B:
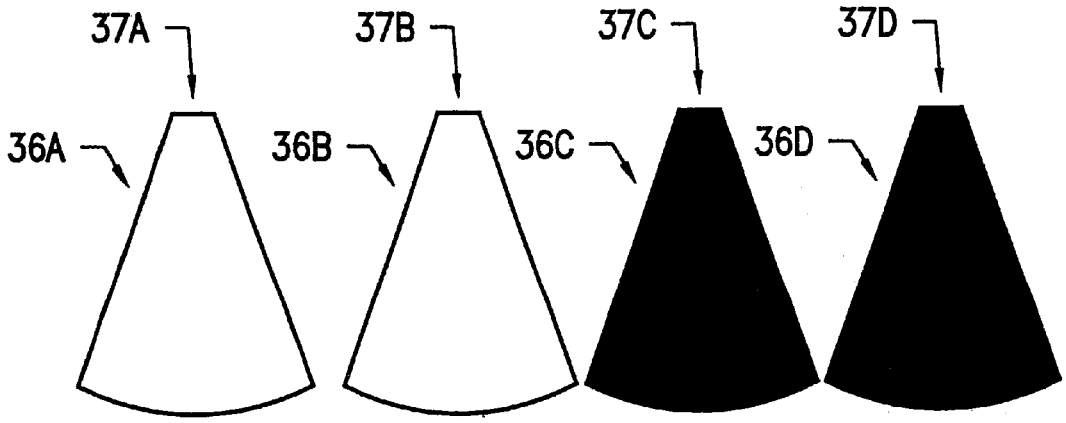
Figure 10B:
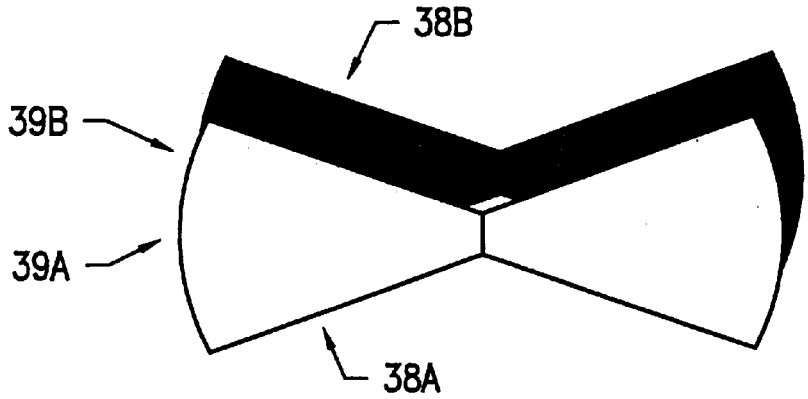

FIG. 10*b* shows another method of making the present invention having pyramidal sections. Here, triangular pieces of fabric (36*a* and 36*b*) are joined at vertices (37*a* and 37*b*) forming panel (38*a*). Triangular pieces of fabric 36*c* and 36*d* are joined at vertices 37*c* and 37*d* forming panel (38*b*). Panels 38*a* and 38*b* are joined along their respective side axis 39*a* and 39*b* to form a cone. The same method may also be employed using additional panels to create 3 or 4 sided pyramidal first and second sections. Alternatively, the step of making the panels using triangular pieces of fabric may be omitted and cone-shaped panels without center seams may be used.

Figure 10C:
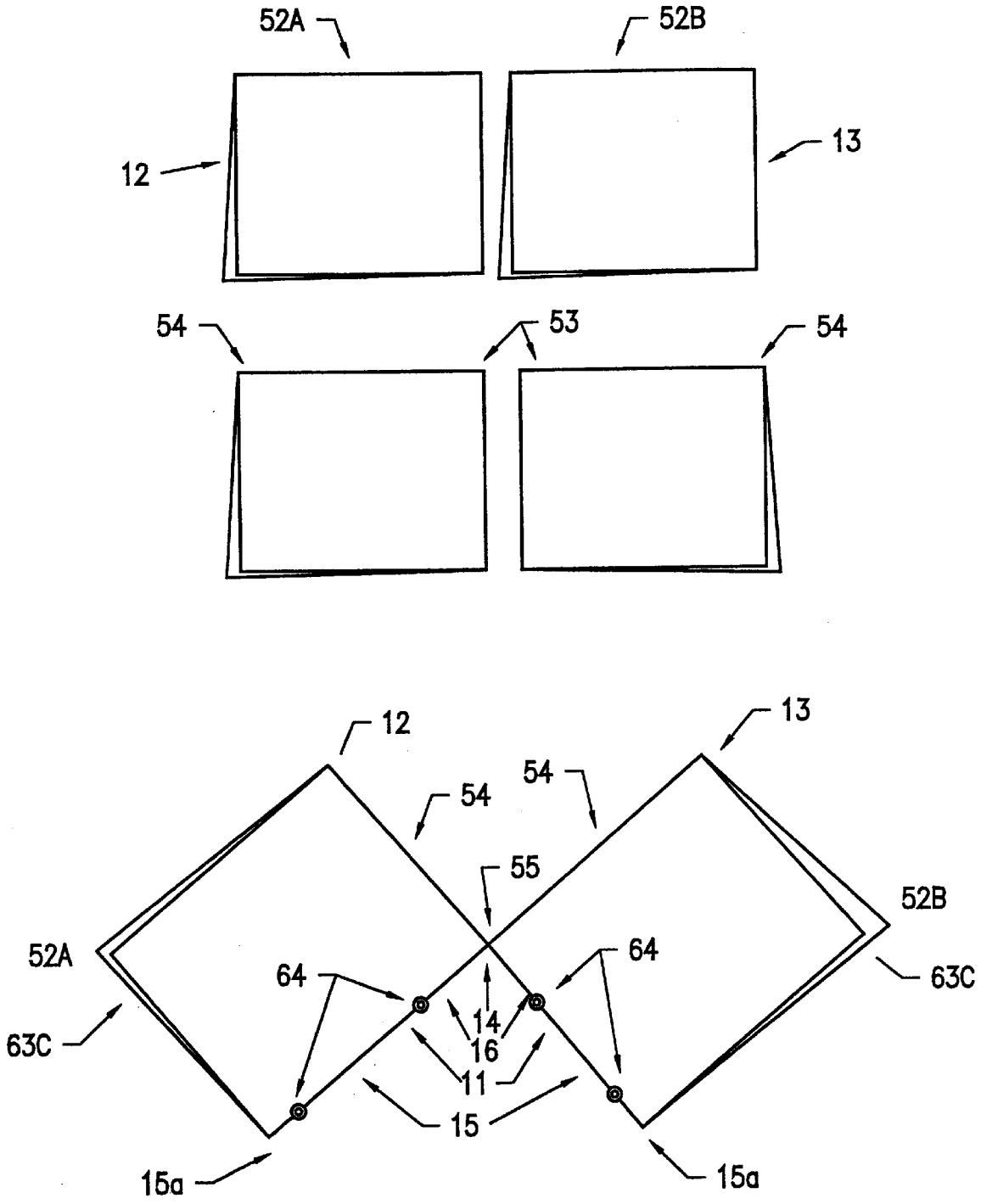

FIG 10*c* shows another method of making the present invention having planar first and second sections (12 and 13). In making this embodiment, at least two pieces of fabric (52*a* and 52*b*) are folded into a diamond shape having corners (53) at the area where the fabric is folded (54). As used herein, the term "diamond shape" includes a square, rectangle, rhombus or any other parallelogram. At least two folded pieces of fabric are then connected to each other at their respective corners (53) by a fastening means (55). When the resulting garment is worn, the first and second sections (12 and 13) form a collapsed cone-shaped configuration.

Figure 11A:
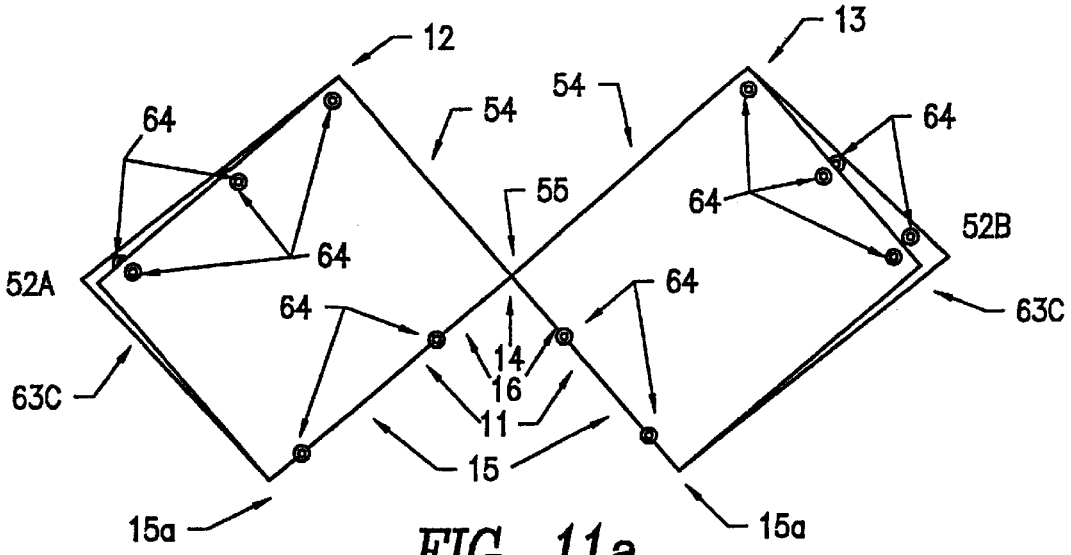
FIGS. 11*a*–11*h* illustrate multiple uses of the present invention.
Figure 11B:
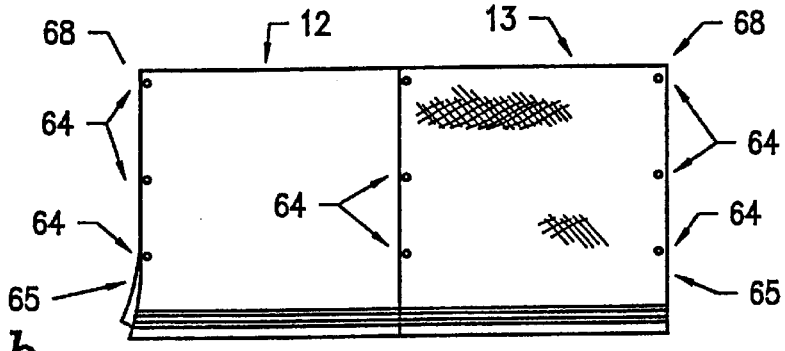
Figure 11C:
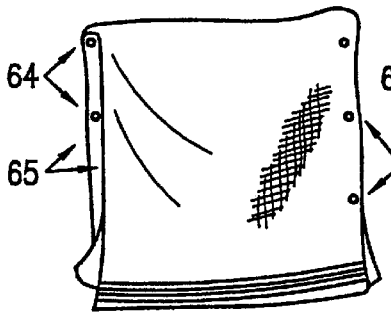
Figure 11D:
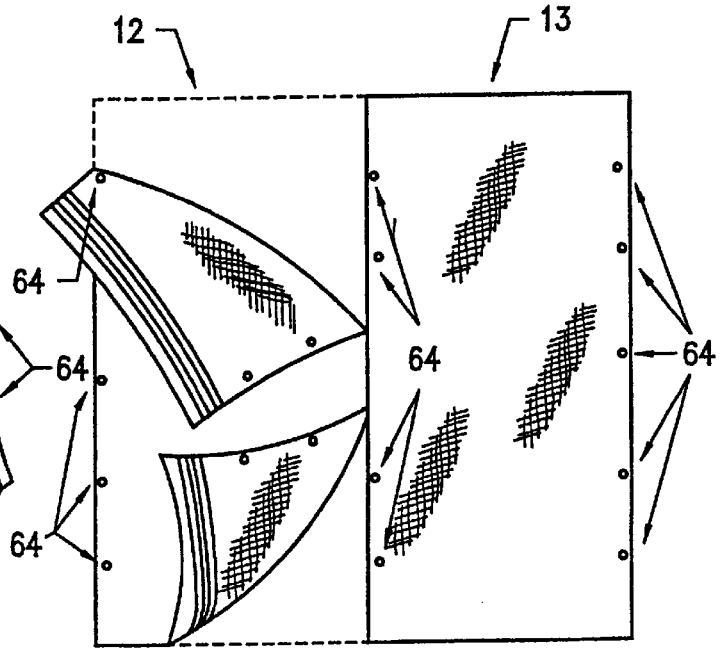
Figure 11E:
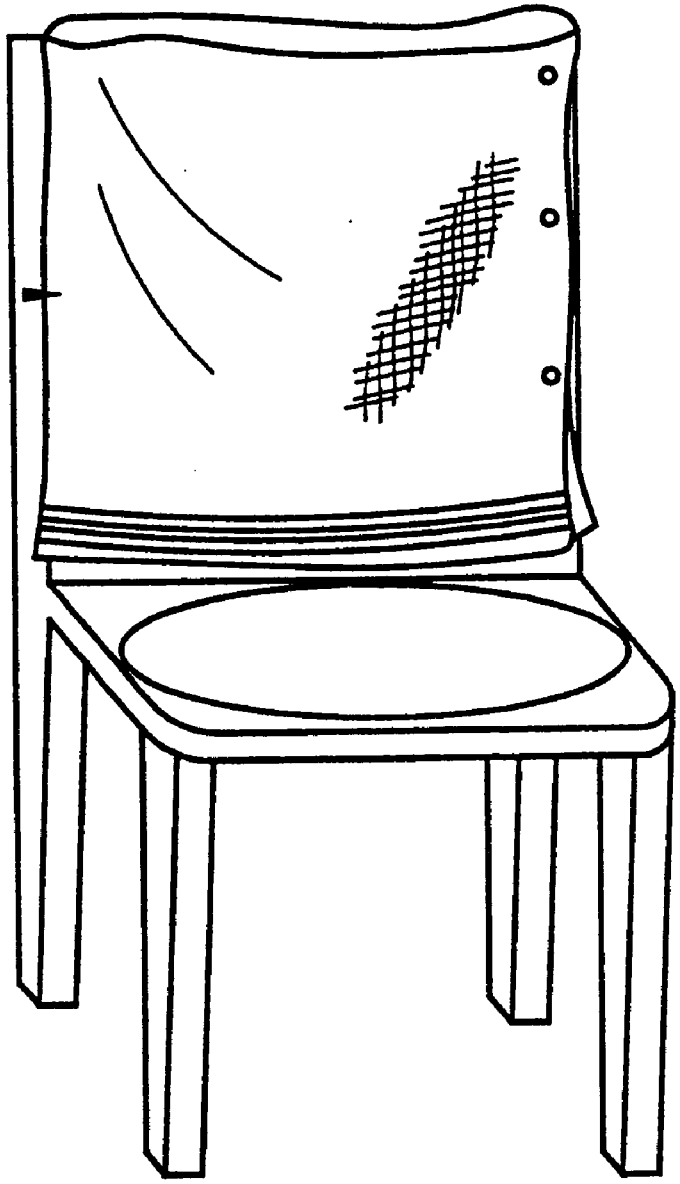
Figure 11F:
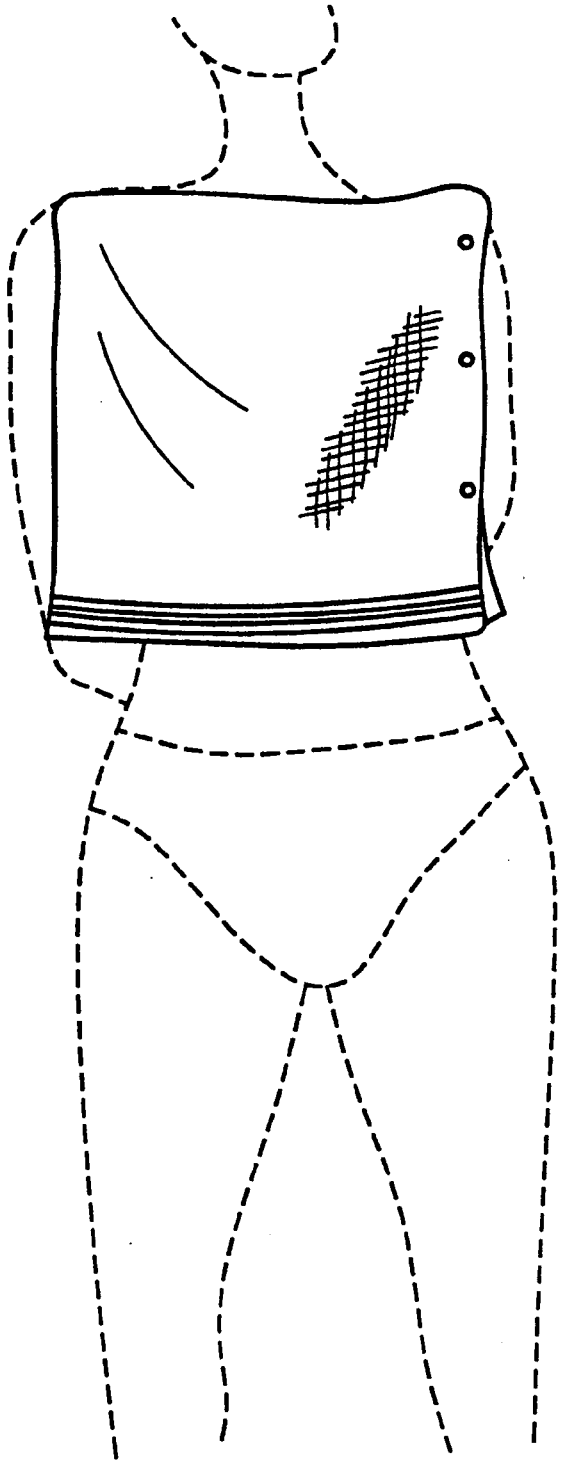
Figure 11G:
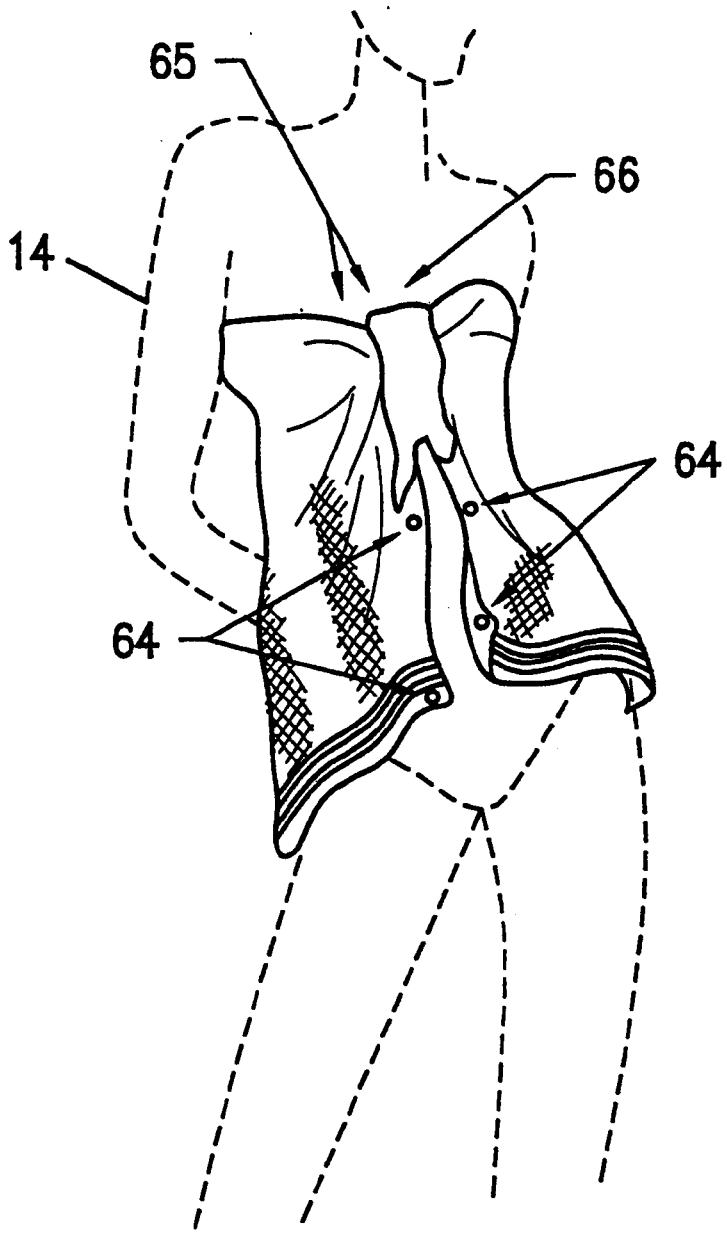
Figure 11H:
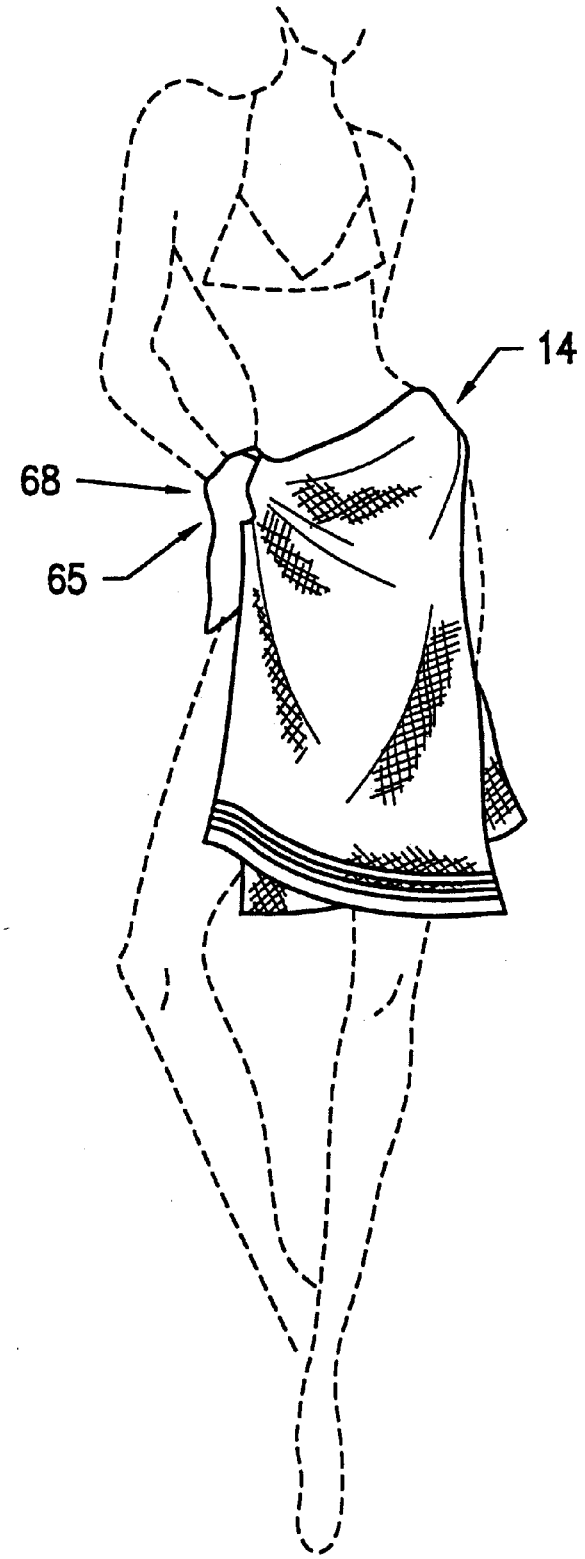

FIGS. 11*a*–11*d* illustrate examples of the various configurations of the present invention. FIG. 11*a* shows the embodiment of FIG. 10*c* having fasteners (64) along at least one edge of the garment. FIG. 11*b* shows the embodiment of FIG. 11*a* with fasteners (64) attaching first and second sections (12 and 13). FIG. 11*c* shows the embodiment of FIG. 11*b* with outer edges (65) fastened together. The embodiment of FIG. 11*c* may be used as a chair cover (FIG. 11*e*), seat cushion, poncho or camisole (FIG. 11*f*). FIG. 11*d* shows the embodiment of FIG. 11*a* wherein both first and second sections (12 and 13) are unfurled to form a two dimensional piece of fabric having various uses, including a beach towel, poncho, pareo, picnic blanket or table cover. FIG. 11*g* shows the embodiment of FIG. 11*b* used as a halter top. Here, the vertex of the garment (14) is situated at or about the center of the wearers back. The unattached folded corners of the garment (65) are tied across the wearer's sternum (66). Fasteners (64) may be placed along the edge of the garment. FIG. 11*h* shows the embodiment of FIG. 11*a* used as a pareo. Here, the vertex of the garment (14) is situated at the wearer's hip and the unattached folded corners (68) of the outer edges (65) are tied over the opposing hip.

These and other features and objects of the present garment will be more fully understood in light of the specification. Further, the invention illustratively disclosed herein suitably might be practiced in the absence of any element which is not specifically disclosed herein. Further, it should be understood that the specifically disclosed embodiments are exemplary in nature and are not to be construed as limiting the scope of the invention, as set forth in the appended claims.

I claim:

1. A garment comprising a fabric for draping around an area of a body having a configuration comprising:

first and second sections that are both either conic or pyramidal; the first and second sections are of substantially equal size arranged on opposite sides of a vertex, the first and second sections are joined at the vertex;

a vertex is at a fixed point situated generally along a first direction; the proximal portion of each of the first and second sections is situated about the area where the vertex joins such sections; the medial portion of the garment generally extends along the first direction between the proximal portions of the first and second sections;

distal portions of the first and second sections having greater fabric surface than the medial portion so that when the medial portion is draped around an area of the body, the area medial portion imparts a more sparse appearance of fabric about the area of the body which the medial portion is engaged than the distal portion of the first and second sections; and when the garment is draped around an area of the body, the first and second sections form a generally collapsed cone-shaped configuration.

2. The garment of claim 1, wherein the ends of said distal portions furthest away from the vertex extend generally in a direction perpendicular to the first direction.

3. The garment of claim 1, wherein the ends of said distal portions furthest way from the vertex along the first direction is elliptic.

4. The garment of claim 1, wherein the ends of said distal portions furthest way from the vertex along the first direction is cheveroned.

5. The garment of claim 1, wherein the vertex joining the first and second sections is truncated.

6. The garment of claim 1, wherein the first and second sections are separated by an elongate.

7. The garment of claim 1, wherein the garment has an elongated tube extending along the first direction between the first and second sections.

8. The garment of claim 1, wherein the fabric comprises substantially stretch resistant and absorbent material.

9. The garment of claim 8, wherein said substantially stretch resistant and absorbent material is selected from the group consisting of Turkish terry, French terry, velour, baby terry, boucle or any combination thereof.

10. The garment of claim 8, wherein the substantially stretch resistant and absorbent material is a single sided terry.

11. The garment of claim 1, wherein the fabric comprises an insulating material.

12. The garment of claim 11, wherein the insulating material is selected from the group consisting of wool, microfiber, fleece or any combination thereof.

13. The garment of claim 1, wherein the fabric comprises a water repellant material.

14. The garment of claim 13, wherein the water repellent material is selected from the group consisting of nylon, rubber, plastic, Teflon or any combination thereof.

15. The garment of claim 1, wherein the fabric is selected from the group consisting of cotton, linen, silk, nylon, rayon, mesh, leather, velvet, cashmere, camel hair or any combination thereof.

16. The garment of claim 1 having at least one pocket between the distal and the proximal portions of the first and second sections.

17. The garment of claim 16, wherein said pockets have means for opening and closing said pocket.

18. The garment of claim 1, wherein said garment has at least one fasten means along the edges of the first and second sections.

19. The garment of claim 1, wherein either of said first and second section is emblazoned.

20. The garment of claim 1, wherein said first and second sections are fastened to each other along their respective edges to form a poncho, camisole, chair cover or seat cushion.

21. A method of king a garment comprising:

providing first and second sections that are conic providing the first and second sections of substantially equal size arranged on opposite sides of a vertex, joining the first and second sections at the vertex;

situating the vertex at a fixed point generally along a first direction; situating a proximal portion of each of the first and second sections about an area where the vertex joins such sections; situating a medial portion of the garment generally along the first direction between the proximal portions of the first and second sections; providing distal portions of the first and second sections with greater fabric surface than the medial portion so that when the medial portion is draped around an area of the body, the medial portion imparts a more sparse appearance of fabric about the area of the body which the medial portion is engaged than the distal portion of the first and second sections; and generally forming a collapsed cone-shaped configuration with the first and second sections when the garment is draped around an area of the body;

and forming the conic by the steps of folding two square pieces of fabric to form two triangles and attaching a corner of each triangle together to form conic sections.

22. A method of making a garment comprising:

providing first and second sections that are both conic or pyramidal; providing the first and second sections of substantially equal size arranged on opposite sides of a vertex, joining the first and second sections at the vertex;

situating the vertex at a fixed point generally along a first direction; situating a proximal portion of each of the first and second sections about an area where the vertex joins such sections; situating a medial portion of the garment generally along the first direction between the proximal portions of the first and second sections; providing distal portions of the first and second sections with greater fabric surface than the medial portion so that when the medial portion is draped around an area of the body, the medial portion imparts a more sparse appearance of fabric about the area of the body which the medial portion is engaged than the distal portion of the first and second sections; and generally forming a collapsed cone-shaped configuration with the first and second sections when the garment is draped around an area of the body;

and forming the sections by the steps of joining at least two triangular pieces of fabric at a vertex to from a panel; and/or connecting at least two panels along their respective axis to form the cone or pyramid.

23. A method of making a garment comprising:

providing first and second sections that are pyramidal; proving the first and second sections of substantially equal size arranged on opposite sides of a vertex, joining the first and second sections at the vertex;

situating the vertex at a fixed point generally along a first direction; situating a proximal portion of each of the first and second sections about an area where the vertex joins such sections; situating a medial portion of the garment generally along the first direction between the proximal portions of the first and second sections; providing distal portions of the first and second sections with greater fabric surface than the medial portion so that when the medial portion is draped around an area of the body, the medial portion imparts a more sparse appearance of fabric about the area of the body which the medial portion is engaged than the distal portion of the first and second sections; and generally forming a collapsed cone-shaped configuration with the first and second sections when the garment is draped around an area of the body;

and forming the pyramidal sections by the steps of folding at least two pieces of fabric into a diamond shape having corners at the area wherein the fabric is folded and connecting the at least two pieces of fabric at said corners.

* * * * *